US006038900A

United States Patent [19]

Miyasaka

[11] Patent Number: 6,038,900

[45] Date of Patent: Mar. 21, 2000

[54] METHOD FOR A SURFACE TREATMENT OF METALLIC PRODUCT

[75] Inventor: Yoshio Miyasaka, Aichi, Japan

[73] Assignee: Fuji Kihan Co., Ltd., Aichi, Japan

[21] Appl. No.: 09/320,055

[22] Filed: May 26, 1999

[30] Foreign Application Priority Data

Feb. 6, 1998 [JP] Japan ..... 10-153254

[51] Int. Cl.[7] ..... C21D 7/06; B21D 53/10

[52] U.S. Cl. ..... 72/53; 29/90.7

[58] Field of Search ..... 72/53; 29/90.7

[56] References Cited

U.S. PATENT DOCUMENTS

| | | | |
|---|---|---|---|
| 3,100,724 | 8/1963 | Rocheville . | |
| 3,754,976 | 8/1973 | Babecki . | |
| 4,049,857 | 9/1977 | Hammer . | |
| 4,228,670 | 10/1980 | Corti et al. | 72/53 |
| 4,250,726 | 2/1981 | Safian et al. | 72/53 |
| 4,552,784 | 11/1985 | Chu . | |
| 4,581,913 | 4/1986 | Reed | 72/53 |
| 4,714,622 | 12/1987 | Omori et al. | 72/53 |
| 4,753,094 | 6/1988 | Spears | 72/53 |
| 5,087,486 | 2/1992 | De Vos . | |
| 5,302,414 | 4/1994 | Alkhimov . | |
| 5,330,790 | 7/1994 | Calkins . | |
| 5,596,912 | 1/1997 | Laurence et al. | 72/53 |
| 5,816,088 | 10/1998 | Yamada et al. | 72/53 |

FOREIGN PATENT DOCUMENTS

| | | | |
|---|---|---|---|
| 2156-020 | 6/1990 | Japan | 72/53 |

*Primary Examiner*—David Jones
*Attorney, Agent, or Firm*—Dennis G. LaPointe; Mason & Assoc., P.A.

[57] ABSTRACT

The present invention relates to a method for a surface treatment of a metallic product. In this method, by conducting one step of injecting mixture shots including at least two types of shots comprised of different or same materials consisting of high hardness metal or metallic component and having different shot diameters between 0.6 and 0.03 mm onto the surface of a metallic product at an injection pressure of not less than 0.29 MPa or not less than 50 m/sec, the residual compressive stress of the surface of the metallic product and that of a lower surface layer are made at least −1200 MPa and that of a portion having a depth of about 50 μm below the surface of the metallic product is made −1300 MPa or higher.

10 Claims, 5 Drawing Sheets

METHOD FOR A SURFACE TREATMENT OF METALLIC PRODUCT

BACKGROUND OF THE INVENTION

1. Field of the Invention

The present invention relates to a surface treatment of a metallic product such as a tool and a machine part, and particularly relates to a method for a surface treatment including a single step aimed to harden the surface of a metallic product and to increase fatigue strength thereof by heat treatment and hardening and by generating a residual compressive stress on the surface thereof and to exhibit advantages of enhancing the quality of the surface by heat treatment, of enhancing the residual compressive stress deeper inside the surface thereof and of relieving the surface roughness, without the need to conduct many shot peening steps or a treatment step, such as a polishing step, after a peening step.

2. Description of the Related Art

Conventionally, there has been known, as a method for a surface treatment of a metallic product, shot peening by which all of or part of a metallic product, such as a cast steel product, a casting product and a stainless steel product which are formed into a spring or product shape, is subjected to quench-and-temper treatment and then to cold working. In the shot peening method, a product is quenched at about 850° C. by means of high frequency induction heating and tempered at about 600° C., to thereby transform the surface structure of the product. Thereafter, the resultant product is subjected to air-cooling and to normal peening at ordinary temperature or to warm peening to generate a residual compressive stress, thereby increasing fatigue strength.

In the above-stated shot peening, a plastic deformation resulting from an impact which occurs when injecting a shot on the surface of the metallic product causes a residual compressive stress on the surface of the metallic product. Thus, the residual compressive stress is proportional to the size of a depression which is the plastically deformed portion. The size of the depression or plastically deformed portion is also proportional to the diameter of a shot, so that the residual compressive stress is proportional to the shot diameter, as well.

That is, to provide a residual compressive stress of a portion deep inside the surface layer and to harden the metallic product deeper inside, use of a shot of large particle diameter, conventionally about 1.2 to 0.6 mm, was useful.

In the specification, a shot of a diameter of about 0.3 mm or more is referred to as "large shot" and a shot of a diameter of less than 0.3 to about 0.03 mm is referred to as "small shot".

Further, in the above-stated surface treatment method, it is required to separate a heat treatment step from a shot peening step. Due to this, step management involving temperature control tends to be complicated and cost tends to increase accordingly. To overcome these disadvantages, the present applicant already developed "a surface working and heat treatment method for a metallic product" (Japanese Patent No. 1594395). In this patent, 40 to 200$\mu$ shots of a hardness equal to or higher than that of a metallic product are injected on the surface of the metallic product at an injection speed of 100 m/sec or higher, the temperature in the vicinity of the surface is increased to be higher than an $A_3$ transformation point, blasting is conducted to thereby harden the surface of the metallic product following the generation of a residual compressive stress on the surface thereof and to increase the fatigue strength, and heat treatment is conducted to thereby improve the quality of the surface.

The conventional surface treatment method, however, still has the following disadvantages to be further solved.

As stated above, the conventional surface treatment method requires using a relatively large diameter shot so as to obtain a residual compressive stress, for work-hardening or heat treatment hardening the metallic product deep inside the surface of the metallic product. However, if the shot diameter is larger, the shot has disadvantageous in that the service life become shorter and in that the shot cracks more frequently.

The reason is as follows. The momentum of the shot injected at the same speed increases proportionally with the cube of the shot diameter. Therefore, an impulse resulting from the strike is also proportional to the cube of the shot diameter. The area of the destructive part when the shot cracks is proportional to the square of the shot diameter and yield strength is also proportional to the square of the shot diameter. Thus, it is clear that a larger shot tends to crack more easily and that its service life is, therefore, shorter.

If a shot easily cracks, manufacturing cost increases and stable injection is not ensured. Further, the cracking shot causes a failure in a shot peening apparatus. Besides, if the shot is larger, an impact applied on the apparatus itself increases, thereby causing not only shot cracking but also cost increase as a result of damages to the apparatus.

Further, the cracking shot has a sharp corner at the end of the cracking surface. If the cracking shot strikes the surface of a metallic part, it does not produce a depression but enters the surface to cause a cutting action, thereby resulting in the rougher surface of the metallic product.

Conventionally, cast iron shots, cast steel shots and cut wire shots are mainly used. Their service lives are limited.

Moreover, if shot peening is applied on the surface of a metallic product using large shots, the metallic product has a aventurine roughened surface. As a result, if a shot is larger in diameter, the surface become roughened further. Additionally, the large shot tends to crack and the cracking shot cuts the surface of the metallic product to make the surface rougher. With the surface roughened, the metallic product may not be available for use. Also, the residual compressive stress below the surface of the metallic product or product to be treated cannot be obtained.

To solve the above-stated disadvantages, after hard shot peening using large shots is conducted, peening using smaller shots is conducted. Alternatively, after peening, CBN polishing is conducted to relieve the surface roughness and to enhance a residual compressive stress below the surface. In either case, a plurality of treatment steps are required and cost increase is inevitable.

Additionally, according to "surface working and heat treatment method for a metallic product" (Japanese patent No. 1594395), a shot having a diameter of 40 to 200$\mu$ is utilized to attain high injection speed based on the relationship between the injection speed and injection density. With this method, however, there is a limit to the depth below the surface of the metallic product by which residual compressive stress occurs and the product is hardened by heat treatment.

The present invention has been developed to overcome the above-stated disadvantages. It is, therefore, an object of the present invention to provide a surface treatment method for a metal part which can generate a residual compressive stress in a position below the surface of a metallic product and deeper than the surface layer, which can relieve surface roughness by conducting shot peening having advantages of generating a residual compressive stress to thereby conduct hardening heat treatment to the surface of the metallic product and to enhance fatigue strength thereof by blasting treatment using mixture shots comprised of hard strength, hard hardness material and including small shots and large shots of different shot diameters, and having an advantage of enhancing the quality of the surface by means of heat treatment, and which method can, in particular, dispense with multiple-step shot peening or a treatment step such as polishing after peening as seen in the conventional method.

SUMMARY OF THE INVENTION

To achieve the above object, a method for a surface treatment according to the present invention includes injecting mixture shots including shots having different shot diameters and comprised of metal or metallic component having a hardness equal to or greater than a hardness of a metallic product onto a surface of the metallic product to thereby enhance the surface hardness of the metallic product, and is characterized in that shot injection is conducted at least at an injection pressure of not less than 0.29 MPa or not less than 50 m/sec.

The shot shape is preferably, but not limited to, spherical.

The shot diameters of the mixture shots may include diameters of 0.6 to 0.03 mm at random.

Further, the shape, material, hardness and diameter of the shot constituting the mixture shots can be selected according to purposes. It is preferable that the mixture shots are comprised of the same material in that there is no need to classify shots of different materials after surface treatment.

Moreover, it is preferable that the mixture shots are comprised of material which has higher strength, higher hardness with a service life of about 30 times longer than that of the cast iron and cast steel which have been mainly used as material for the conventional shots with the same shot diameters, and which hardly cracks, such as high-speed tool steel, alloy tool steel or nonferrous alloy steel, and that they have a hardness of not less than Hv1000.

BRIEF DESCRIPTION OF THE DRAWING

The object and advantages of the invention will become understood from the following detailed description of preferred embodiments thereof in connection with the accompanying drawings in which like numerals designate like elements, and in which.

DETAILED DESCRIPTION OF THE PREFERRED EMBODIMENTS

Figure 1:
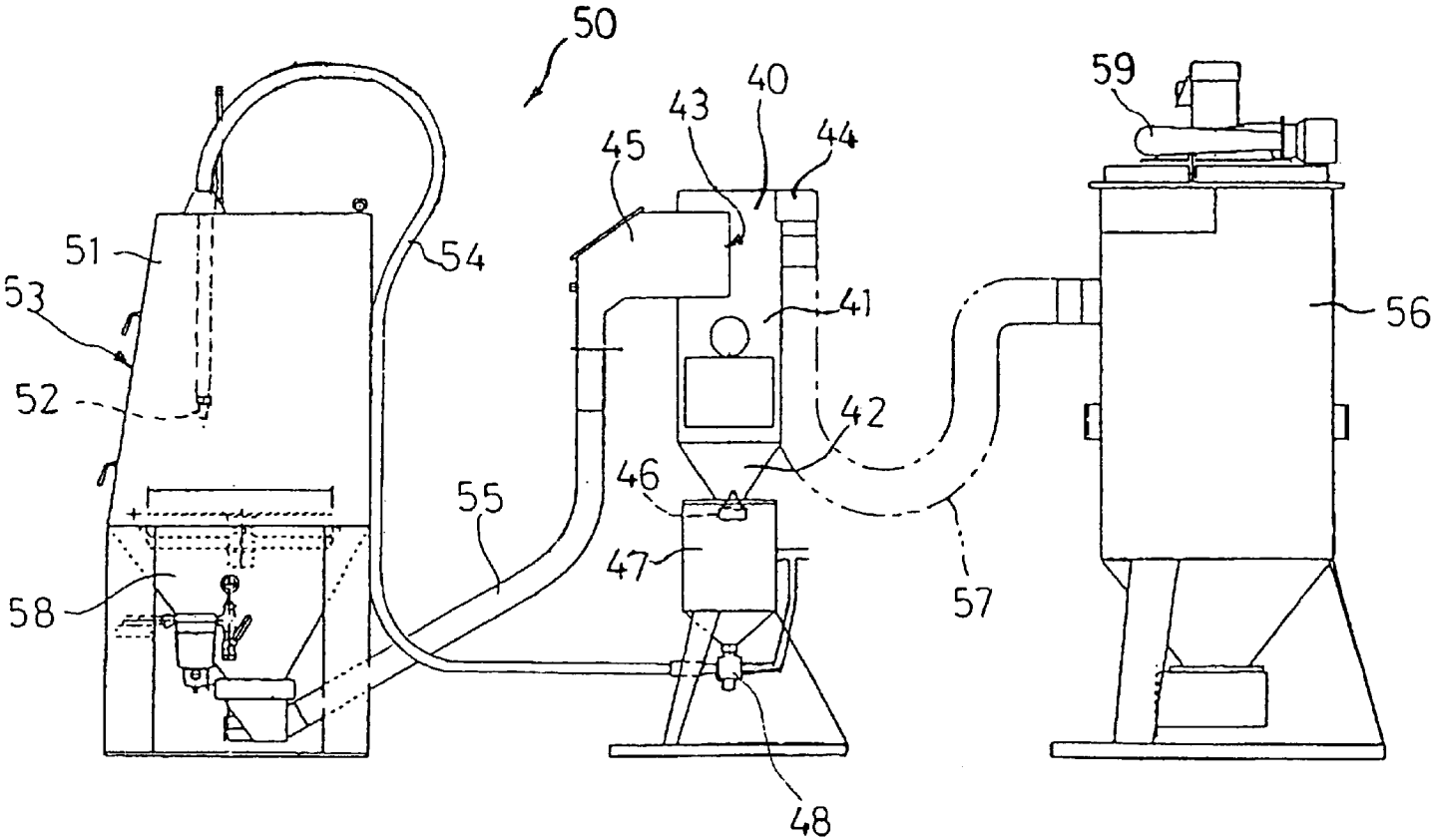
FIG. 1 is a front view showing a blasting apparatus used in embodiments according to the present invention.

When mixture shots B, including shots having a hardness equal to or higher than that of a metallic product A and having different shot diameters, are injected on the surface of the metallic product A at an injection pressure of 0.29 MPa or higher or 50 m/sec or higher, the temperature in the vicinity of the ferrous metallic product A increases to a transformation point $A_3$ or higher, or the temperature in the vicinity of the nonferrous metallic product A increases to a recrystallization temperature or higher.

That is to say, while the change in the speed of the mixture shots B before strike and after strike differs according to the hardness of the metallic product A and that of the mixture shots B, the speed after strike decreases. The change in speed is mostly converted into heat energy according to the energy conservation law. Heat exchange occurs only at a deformed portion struck by the mixture shots B. As a result, temperature rise takes place locally in the vicinity of the surface of the metallic product A.

At this moment, temperature rises not only on the surface of the metallic product A but also on the surface of the mixture shots B. If the metallic product A and the mixture shots B are comprised primarily of iron, the temperatures of the base material of the metallic product A and that of the base material of the mixture shots B reach or exceed the transformation point $A_3$. Since the temperature rise appears locally in the vicinity of the surface layer of the metallic product A and that of the mixture shot B, the metallic product A and the mixture shots B are cooled quickly. In addition, if temperature rise due to continuous shot peening using the mixture shots B is small or cooling speed is slow, then the effect of tempering treatment appears. Thus, the metal structure of the surface layer of the metallic product A is made smaller to thereby provide the metal structure with high strength and high toughness.

It is noted that the temperature rise stated above varies with shot speed. Due to this, temperature rise may be small depending on the injection pressure or injection speed, shot diameter and material. If the metallic product A is made of ferrous material, the temperature does not rise up to or exceed the transformation point $A_3$ of the base material of the metallic product A. In that case, the surface of the metallic product A plastically deforms after the mixture shots B strike the surface thereof. Thus, the hardness and fatigue strength of the surface of the metallic product A are advantageously enhanced.

Description will be given in more detail. If the mixture shots B including shots of different diameters are injected on the surface of the metallic product A, shots of small shot diameters among the mixture shots B strike the surface of the metallic product A at high speed. The change in energy before and after strike is converted into heat energy and therefore, the temperature increases locally in the vicinity of the surface of the metallic product A. Then, as stated above, the metal structure of the surface layer of the metallic product A is made smaller to thereby provide a high strength, high hardness surface layer.

Meanwhile, the shots of large diameters among the mixture shot B strike the surface of the metallic product A at lower speed than that of the small diameter shots. The temperature rise in the vicinity of the surface of the metallic product A is smaller during strike. That is, with large shots, the surface of the metallic product A does not enhance in quality by heat treatment but the plastically deformed portion on the surface of the metallic product A is larger than that in case of the small shots. Thus, by conducting shot peening, a residual compressive stress and hardening occur below the surface layer of the metallic product A, thereby advantageously increasing the hardness of the surface of the metallic product A and increasing fatigue strength.

It is noted that the small shots do not always execute heat treatment to the metallic product A depending on the injection pressure, injection speed, shot diameter and material. Instead, the small shots have a peening effect. Namely, it is possible to select, as required, injection pressure, injection speed, diameter and material for shots to be included in the mixture shot.

The service life of a shot will be described using, for example, a Brinell hardness test. If shots having various shot diameters statically push the same sample to generate a depression, the relationship between pushing force P and the diameter d of the depression to make the ratio of the depression to the diameter of the shot (k=d/D) constant is expressed as:

$$P=\pi D^2k^2C/4 \text{ (c: a constant).}$$

From this, it is found that the shot force per unit cross sectional area is constant.

In actual shot peening, however, shots dynamically strike a product to be treated. If dynamical shot application is taken into consideration in the above hardness test, the momentum of the shots applied at the same speed increases proportionally to the cube of the shot diameter and the impulse of strike is, therefore, proportional to the cube of the diameter. Based on this, the area of the destructive surface as well as yield strength is proportional to the square of the shot diameter. In short, the larger the diameter of the shot is, the shorter the service life thereof becomes.

The large shots among the mixed shots B according to the present invention strike not only the metallic product A but also the small shots because of the difference in shot speed after injection. The strike causes temperature rise at the portions at which the small shots and the large shots strike one another if the relative speed between the large shots and the small shots is high. In case of the ferrous shot, the temperature reaches or exceeds the transformation point $A_3$ and the heat treatment effect, thereby, provides shots with smaller in size, high strength, high hardness structure together with a product to be treated. While the shot materials are ferrous metal such as steel or stainless steel and the shot diameters are not more than 0.3 mm, if normal heat treatment of quenching and tempering is conducted, then shot materials are welded to one another and surface heat treatment for the shot cannot be conducted. Because of the strike between the large shots and the small shots, however, the metal structure of the surface layer of about 20 $\mu$m depth of the shot below the shot application surface is made smaller in size to thereby provide the structure with high hardness and high toughness. In addition, even if the above-stated relative speed is slow and therefore temperature rise is small, shot strike causes plastic deformations and work hardening, thereby providing shots of high strength, high hardness structure.

This can not only enhance the shot service life but also shows an advantage equal to or greater than that in case of the conventional large shots (shot diameters: 1.2 to 0.6 mm) even if shot diameters are smaller than those of the conventional large shots. Besides, by using the shot material of high strength, high hardness and high resistance to cracking, such as high-speed tool steel, alloy machine tool steel or nonferrous alloy, further advantage can be obtained.

The surface hardness of a high-speed tool steel shot is Hv800 on the average. The hardness after shot injection is Hv1000. Even if shots of a high hardness of Hv1300 was used, only a little cracking occurs.

If the large shots strike the surface of the metallic product A, the metallic product has an aventurine roughned surface of high roughness. Further, if the large shots which easily crack strike the surface of the metallic product A, the cracking shots enter the surface of the metallic product A and the surface disadvantageously becomes rougher. By using the mixed shots including small shots, even if the metallic product A has a high roughness surface, small shot peening serves polishing action, resulting in a high quality surface layer.

EMBODIMENTS

The embodiments of the present invention will now be described with reference to the drawings.

A straight hydraulic air blasting apparatus is used as a shot peening apparatus in the present embodiments. However, a suction siphon type, gravity type or other type air blasting apparatuses may be used, as well.

Figure 2:
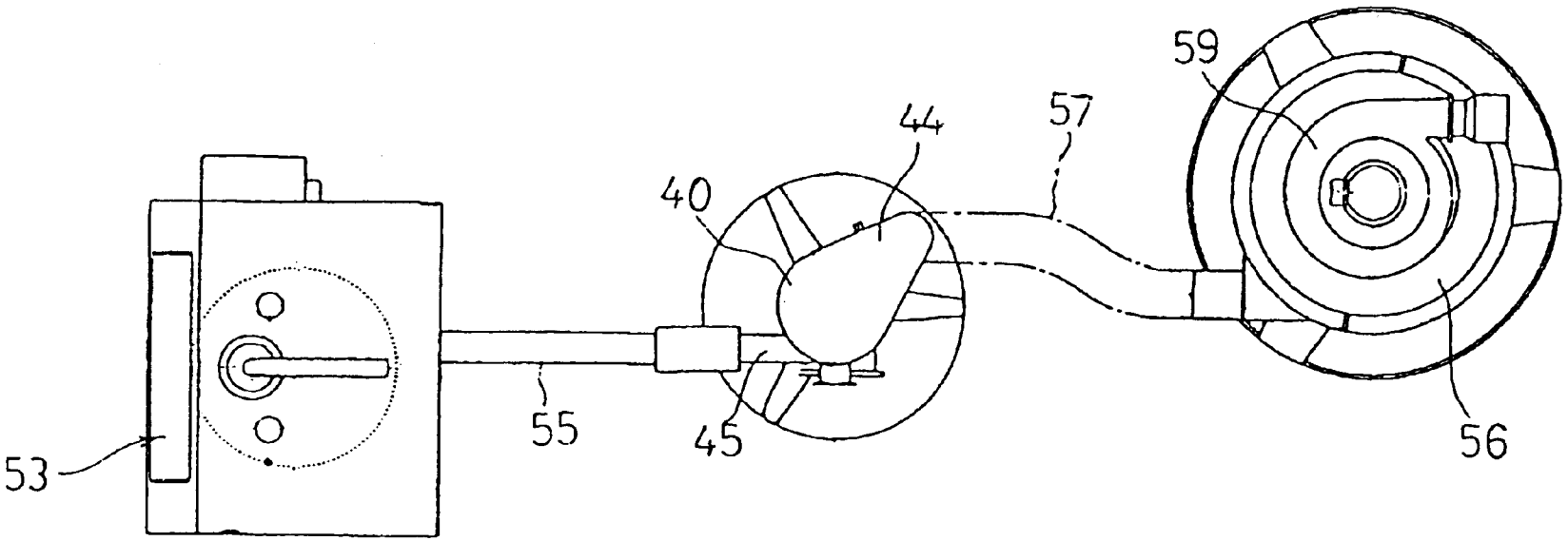
FIG. 2 is a plan view showing the blasting apparatus used in the embodiments according to the present invention.

In FIGS. 1 and 2, reference numeral 50 designates a cabinet which is provided with an input port 53 for inputting a product to be treated. An injection nozzle 52 for injecting shots (note that a shot of metallic component injected from a recovery tank 40 and the injection nozzle 52 is referred to as "shot comprised of metallic material" or simply as "shot" in the present specification), onto the product to be treated inputted from the input port 53 is provided in the cabinet 51.

A hopper 58 is provided on the lower part of the cabinet 51. The lowest end of the hopper 58 communicates with the upper portion of the recovery tank 40 provided near the cabinet 51 for collecting shots through a conductor 55.

The recovery tank 40 is a so-called cyclone for separating dust from shots. As shown in FIG. 1, the tank 40 consists of a cylindrical part 41 of a cylindrical shape at the upper portion of the tank 40 and a conical part 42 of conical shape having diameter gradually narrower downward at the lower portion thereof. An inflow port 43 is provided on the sidewall on the upper portion of the cylindrical part 41 of the recovery tank 40. The conductor 55 is coupled to the inflow port 43 through a communication pipe 45. The axial direction of the communication pipe 45 corresponds to the tangential direction of the inner wall surface, having a circular cross section, of the cylindrical part 41. Due to this, air flow entering the recovery tank 40 through the communication pipe 45 turns downward along the inner wall of the cylindrical part 41.

The lower end of the conical part 42 of the recovery tank 40 freely opens to and communicates with a tank 47 for pressure-feeding shots through a dump valve 46. A shot quantity regulator 48 for regulating the injection quantity of the shots injected from the injection nozzle 52 is provided on the lower end of the tank 47. The tank 47 communicates with the injection nozzle 52 through the shot quantity regulator 48 and the pipe 54.

The straight hydraulic blasting apparatus is characterized in that if compressed air is fed into the tank 47, shots are pressure-fed together with the compressed air toward the injection nozzle 52 through the pipe 54. The shots as well as the compressed air are injected on the product to be treated put in the cabinet 51.

The dump valve 46 vertically moves by the action of a solenoid valve which works with a foot switch or micro-switch which is not shown. The vertical movement of the dump valve 46 allows the recovery tank 40 to open to or shut off from the tank 47. That is, if the dump valve 46 moves upward, the recovery tank 40 is shut off from the tank 47 and the tank 47 is filled with compressed air. Then, the shots within the tank are suppressed by the compressed air and flow into the shot quantity regulator 48. The compressed air and the shots are appropriately mixed in the shot quantity regulator 48, passed through a shot supply port, which is not shown, and injected from the injection nozzle 52 through the pipe 54.

Next, the switch is returned, the dump valve 46 moves downward and the recovery tank 40 opens to the tank 47. Then, the compressed air within the tank 47 escapes into the recovery tank 40 and the pressure within the tank 47 becomes equal to atmospheric pressure. Just before the pressure within the tank 47 becomes atmospheric pressure, as soon as the dump valve 46 moves downward, the injection of the shots from the injection nozzle 52 stops and the shots accumulating at the bottom of the recovery tank 40 fall into the tank 47 altogether.

A coupling pipe 44 is provided almost at the center of the wall surface on the upper end of the recovery tank 40. The coupling pipe 44 communicates with a dust collector 56 through a discharge pipe 57.

The dust collector 56 rotates an exhauster 59 to discharge air within the dust collector 56 to the outside. The exhauster 59 makes the pressure of the cabinet 51, conductor 55 and the interior of the recovery tank 40 negative. In addition, since the compressed air supplied from a compressor, which is not shown, as well as shots is injected from the injection nozzle 52, air flow goes from the cabinet 51 sequentially to the conductor 55, recovery tank 40 and dust collector 56.

[First Embodiment]

By using the above-described blasting apparatus 50, a gear (ϕ 100×20t, SCM420, carburized, quenched and tempered product) was housed into the cabinet 51 from the input port 53 as a product to be treated. Blasting was conducted by injecting mixed shots containing shots of different shot diameters onto the surface of the product to be treated.

The mixture shots, which consist of high-speed tool steel of shot diameters of 0.6 to 0.1 mm, were inputted into the recovery tank 40 and fell into the tank 47.

If compressed air was fed from a compressed air supply source, which is not shown, into the tank 47, the mixture shots were fed together with the compressed air by the shot quantity regulator 48 on the lower part of the tank 47 to the injection nozzle 52 of a diameter of 7 mm through the pipe 54. The mixture shots as well as the compressed air were injected from the injection nozzle 52 onto the product to be treated.

In a first comparison example, surface treatment including two treatment steps, i.e., a step of conducting shot peening using large shots of shot diameters of 0.9 to 0.7 mm and a step of conducting small shot peening using small shots of shot diameters of 0.3 to 0.2 mm, was conducted.

Working conditions and surface roughness (maximum value) of the product to be treated after subjected to surface treatment, residual compressive stress of the surface and that of the depth of 50μ below the surface for the first embodiment and the first comparison example are shown in Table 1 below.

TABLE 1

| | Comparison Example 1 (two-step treatment) | | |
|---|---|---|---|
| Blasting apparatus | First step Straight hydraulic type | Second step Straight hydraulic type | First Embodiment Straight hydraulic type |
| Injection pressure (MPa) | 0.5 | 0.4 | 0.4 |
| Injection nozzle diameter (ϕ mm) | 9 | 5 | 7 |
| Injection distance (mm) | 200 | 200 | 200 |
| Injection time (sec × direction) | 60 × 3 | 60 × 3 | 60 × 3 |

TABLE 1-continued

| Shot Material | Cast steel | Cast steel | High-speed tool steel |
|---|---|---|---|
| Diameter (mm) | 0.9 to 0.7 | 0.3 to 0.2 | 0.6 to 0.1 |
| Hardness (Hv) | 700 | 700 | 1000 |
| Product to betreated Surface roughness (RMAX) | 8 μm | 4 μm | 4 μm |
| Surface stress (MPa) | −400 | −1000 | −1200 |
| (depth of 50 μm) | −1300 | −1300 | −1400 |

Note: To-be-worked object: gear, SCM420, carburized, quenched and tempered product, ϕ 100 × 20 t
Shot hardness: hardness after injection The service life of the product to be treated after the surface treatment in the first embodiment was equal to or longer than that of the product to be treated in the first comparison example.

In first comparison example, after large shot peening using the large shots of diameters of 0.9 to 0.7 mm was conducted in the first step, a residual compressive stress occurred below the surface (50μ). However, in the first step, the surface roughness is high and the residual compressive stress was insufficient in the vicinity of the surface. These disadvantages could be overcome by conducting shot peening using small shots of diameters of 0.3 to 0.2 mm in the second step. In the first embodiment of the present invention, by contrast, it was possible to obtain the advantage equal to or greater than that of the two-step peening in the first comparison example with single-step blasting. In other words, it was possible to obtain the peening effect and the heat treatment effect with one blasting treatment.

Second Embodiment

In the second embodiment, a shaft (SCM420, carburized, quenched and tempered product, ϕ 30×300L) was used as a product to be treated and was subjected to surface treatment using mixture shots consisting of high-speed tool steel and having shot diameters of 0.4 to 0.05 mm as in the same manner as the first embodiment.

In the second comparison example, after shot peening was conducted using large shots of shot diameters of 0.7 to 0.5 mm, surface working and heat treatment, as described in the above-cited Japanese Patent No. 1594395, was conducted using shots of shot diameters of 0.1 mm.

The working conditions and results of the second embodiment and second comparison example are shown in Table 2 below.

TABLE 2

| | Comparison Example 2 (two-step treatment) | | |
|---|---|---|---|
| Blasting apparatus | First step Straight hydraulic type | Second step Straight hydraulic type | Second Embodiment Straight hydraulic type |
| Injection pressure (MPa) | 0.6 | 0.5 | 0.5 |
| Injection nozzle diameter (ϕ mm) | 7 | 5 | 5 |
| Injection distance (mm) | 200 | 200 | 200 |
| Injection time (sec × direction) | 120 × 3 | 100 × 3 | 120 × 3 |

TABLE 2-continued

| Shot Material | Cast steel | High-speed steel | High-speed tool steel |
|---|---|---|---|
| Diameter (mm) | 0.7 to 0.9 | 0.1 | 0.4 to 0.05 |
| Hardness (Hv) | 700 | 1000 | 1000 |
| Product to be treated Surface roughness (RMAX) | 5 μm | 3 μm | 3 μm |
| Surface stress (MPa) | −500 | −1400 | −1400 |
| Stress (depth of 50 μm) | −1200 | −1200 | −1300 |

Note: Product to be treated: shaft, SCM420, carburized, quenched and tempered product, ϕ 30 × 300 t Third Embodiment In the third embodiment, a gear (SCM420, carburized, quenched and tempered product, ϕ 120×15t) was used as a product to be treated and was subjected to surface treatment using mixture shots consisting of high-speed tool steel and having shot diameters of 0.3 to 0.05 mm as in the same manner as the first embodiment.

In the third comparison example, after shot peening was conducted using large shots of shot diameters of 0.8 mm, CBN polishing was conducted.

The working conditions and results of the third embodiment and third comparison example are shown in Table 3 below.

TABLE 3

| | Comparison Example 3 (two-step treatment) | | |
|---|---|---|---|
| Blasting apparatus | Peening Straight hydraulic type | CBN polishing — | Third Embodiment Straight hydraulic type |
| Injection pressure (MPa) | 0.6 | | 0.4 |
| Injection nozzle diameter (ϕ mm) | 9 | | 5 |
| Injection distance (mm) | 200 | | 200 |
| Injection time (sec × direction) | 80 × 3 | | 60 × 3 |
| Shot Material | Carbon steel | | High-speed tool steel |
| Diameter (mm) | 0.8 | | 0.3 to 0.05 |
| Hardness (Hv) | 740 | | 1000 |
| Product to be treated Surface roughness (RMAX) | 8 μm | 1 μm | 2 μm |
| Surface stress (MPa) | −400 | −1400 | −1400 |
| Stress (depth of 50 μm) | −1300 | −1300 | −1500 |

Note: Product to be treated: gear, SCM420, carburized, quenched and tempered product, ϕ 120 × 15 t In the second and third embodiments, it was possible to obtain the peening effect and heat treatment effect with one blasting treatment. Also, since a residual compressive stress occurred below the surface of the product to be treated and the surface roughness was relieved, the surface hardness and fatigue strength of the product to be treated were enhanced.

In the third embodiment, in particular, compared with the third comparison example in which CBN polishing was conducted after peening, the surface roughness was slightly high but the fatigue life increased fivefold.

Figure 3:
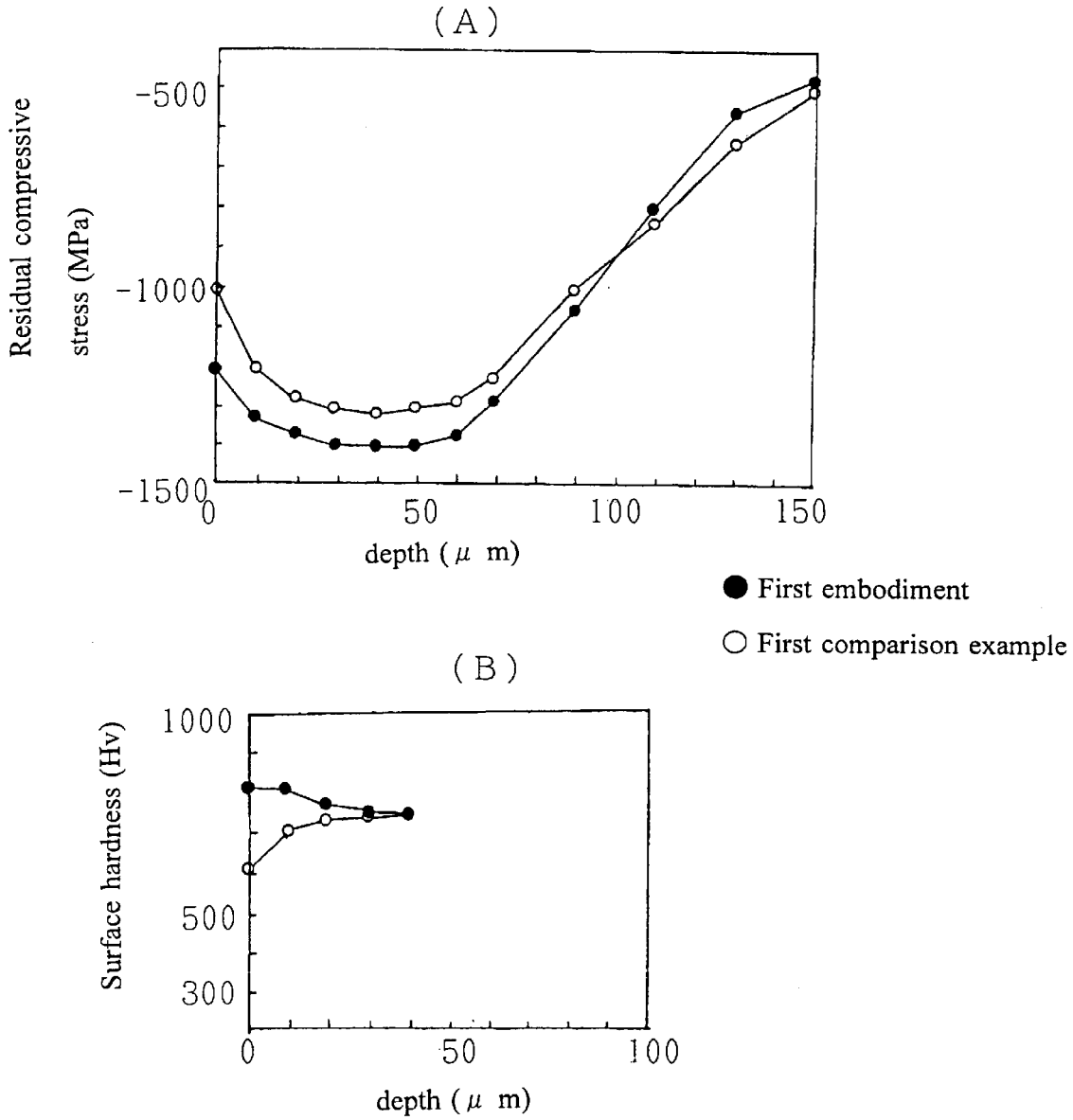
FIG. 3 is a graph showing the relationship between surface hardness (a) and surface depth and that between residual compressive stress (b) and surface depth for the first embodiment and the first comparison example.
Figure 4:
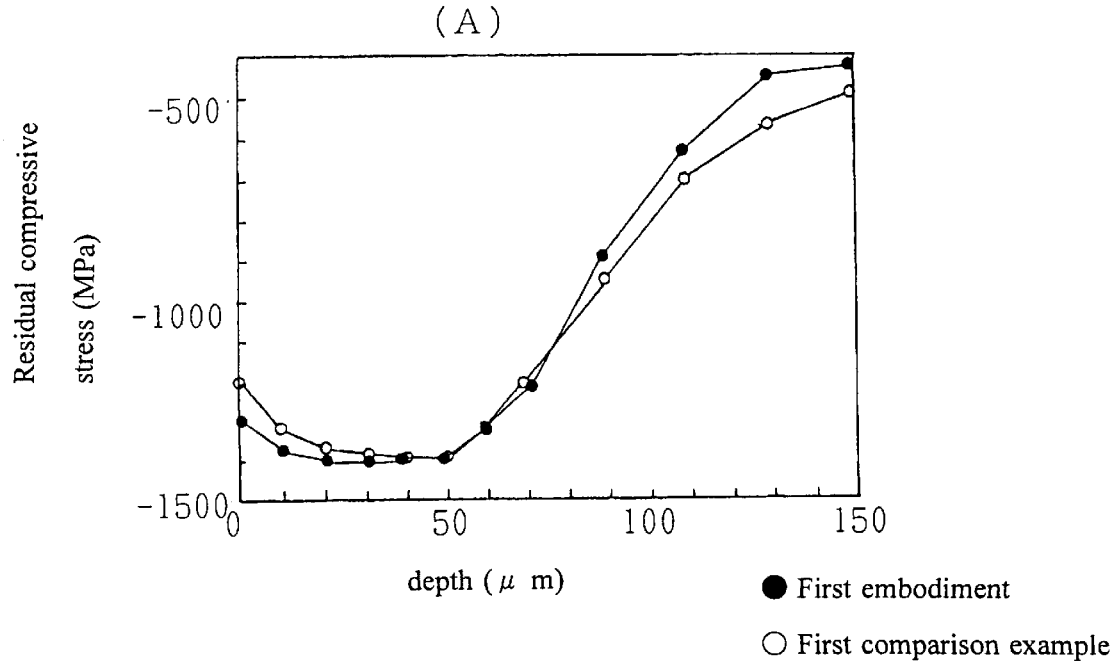
FIG. 4 is a graph showing the relationship between surface hardness (a) and surface depth and that between residual compressive stress (b) and surface depth for the second embodiment and the second comparison example.
Figure 4:
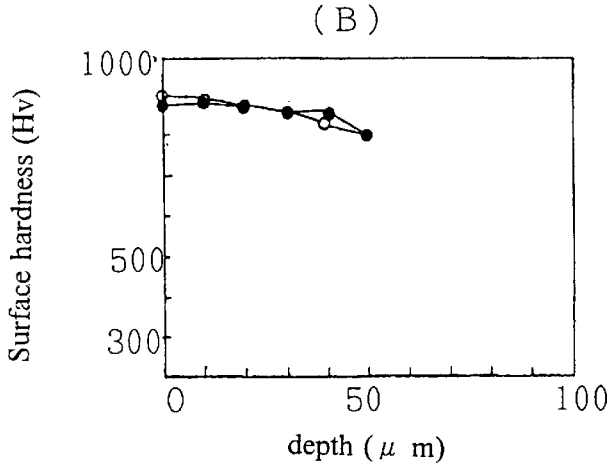
Figure 5:
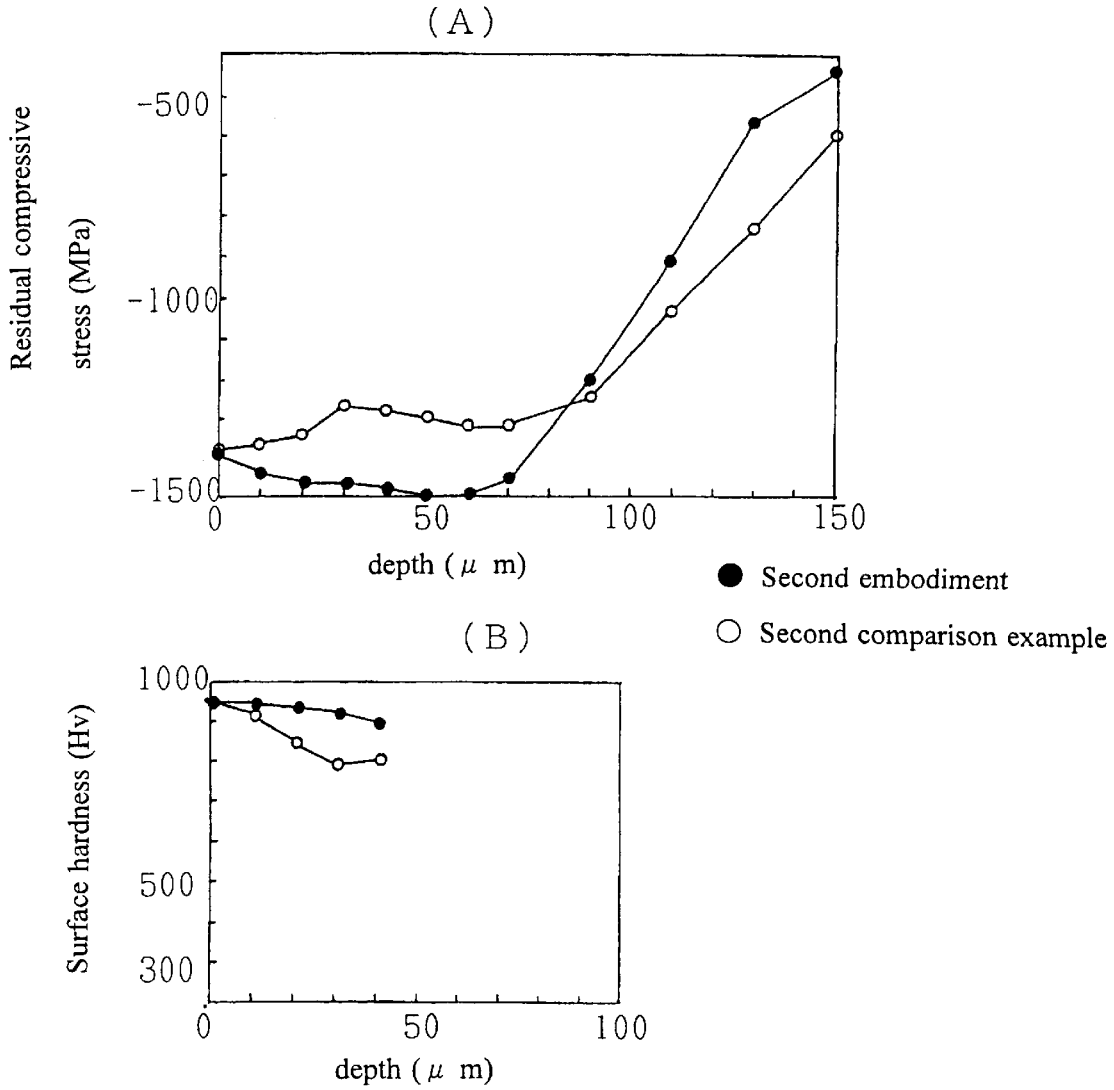
FIG. 5 is a graph showing the relationship between surface hardness (a) and surface depth and that between residual compressive stress (b) and surface depth for the third embodiment and the third comparison example.

As for the respective embodiments and comparison examples, the relationship between the surface hardness Hv(a) and the depth below the surface and that between the residual compressive stress (b) and the depth below the surface are shown in FIGS. 3 to 5.

As is obvious from FIGS. 3 to 5, the first to third embodiments in which one blasting treatment was conducted using mixture shots including shots of different diameters shows the advantages equal to or greater than those of the first to third comparison examples for the conventional surface treatment methods requiring two treatment steps, i.e., large shot peening and small shot peening or peening and polishing, in respect of surface hardness and residual compressive stress.

The present invention has the constitution stated above and exhibits the following advantages.

In a method for a surface treatment including injecting shots comprised of metal or metallic component and having a hardness equal to or higher than that of a metallic product on the surface of the metallic product to thereby enhance the surface hardness of the metallic product, the shot injection is conducted at an injection pressure of 0.29 MPa or higher or 50 m/sec or higher and the shots are the mixture shots including shots having different shot diameters. Due to this, the large shots using shots of large diameters causes plastic deformations to the metallic product and enhances peening effect, whereas the small shots using shots of small diameters relieves the surface roughness of the metallic product and, in some cases, increase temperature in the vicinity of the surface to thereby make the metallic structure smaller in size and to enhance the surface hardness and durability of the metallic product. In particular, only one blasting treatment according to the present invention makes it possible to obtain the same advantages as or greater advantages than those of the conventional method which requires two treatment steps to obtain them.

Since the mixture shots including shots of different shot diameters are used, shot speed varies according to the shot diameters and different diameter shots strike against one another. The strike results in temperature rise, which can, in turn, enhance the hardness of the shot material itself and can, therefore, generate shots which hardly crack.

Blasting is conducted using the mixture shots which consist of, for example, high-speed tool steel, alloy tool steel or nonferrous alloy steel, which have higher strength, higher hardness than those of the cast steel shots and which hardly crack. Owing to this, it is possible to prevent a failure in the blasting apparatus caused by cracking shots, to prevent the surface of the product to be treated from being roughened and to conduct stable blasting.

Thus, the broadest claims that follow are not directed to a machine that is configuration a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation as to protect the heart of this invention, as a matter of law.

It will thus be seen that the objects set forth above, and those made apparent from the foregoing description, are efficiently attained. Also, since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described;

What is claimed is:

1. A metallic product surface treatment method comprising the step of:

injecting onto a surface of a metallic product to be treated a mixture of at least two different diameter shots, the shots being made from a material having a hardness wherein the hardness is at least equal to a hardness of the product to be treated and wherein the shots are injected at an injection pressure of at least 0.29 MPa and at a velocity of at least 50 m/sec.

2. A metallic product surface treatment method comprising the step of:

injecting onto a surface of a metallic product to he treated a mixture of at least two different diameter shots, the shots being made from a material having a hardness wherein the hardness is at least equal to a hardness of the product to be treated and wherein the shots are injected at an injection pressure of at least 0.29 MPa.

3. A metallic product surface treatment method comprising the step of:

injecting onto a surface of a metallic product to be treated a mixture of at least two different diameter shots, the shots being made from a material having a hardness wherein the hardness is at least equal to a hardness of the product to be treated and wherein the shots are injected at a velocity of at least 50 m/sec.

4. The method of any one of claims 1, 2 or 3 wherein the mixture of at least two different diameter shots is made from high strength, high hardness materials including high-speed tool steel, alloy tool steel, nonferrous steel and combinations thereof.

5. The method of any one of claims 1, 2 or 3 wherein the diameter of the shots are 0.6 to 0.03 mm.

6. The method of any one of claims 1, 2, or 3 wherein surfaces of the shots are further work-hardened and surface quality of the shots is enhanced by striking the different diameter shots against one another.

7. A metallic product surface treatment method comprising the step of:

injecting onto a surface of a metallic product to be treated, a mixture of shots having different diameters between 0.6 and 0.03 mm and made from high speed tool steel, alloy steel, nonferrous steel and combinations thereof, the shots having a hardness of at least Hv1000, the shots being injected at an injection pressure of at least 0.29 MPa and at a velocity of at least 50 m/sec, wherein a residual compressive stress of at least −1200 MPa is created on the surface of the metallic product to be treated, and wherein a residual compressive stress of at least −1300 MPa is created at a depth of about 50 $\mu$m below the surface of the metallic product to be treated.

8. A metallic product surface treatment method comprising the step of:

injecting onto a surface of a metallic product to be treated, a mixture of shots having different diameters between 0.6 and 0.03 mm and made from high speed tool steel, alloy steel, nonferrous steel and combinations thereof, the shots having a hardness of at least Hv1000, the shots being injected at an injection pressure of at least 0.29 MPa, wherein a residual compressive stress of at least −1200 MPa is created on the surface of the metallic product to be treated, and wherein a residual compressive stress of at least −1300 MPa is created at a depth of about 50 $\mu$m below the surface of the metallic product to be treated.

9. A metallic product surface treatment method comprising the step of:

injecting onto a surface of a metallic product to be treated, a mixture of shots having different diameters between 0.6 and 0.03 mm and made from high speed tool steel, alloy steel, nonferrous steel and combinations thereof, the shots having a hardness of at least Hv1000, the shots being injected at a velocity or at least 50 m/sec, wherein a residual compressive stress of at least −1200 MPa is created on the surface of the metallic product to be treated, and wherein a residual compressive stress of at least −1300 MPa is created at a depth of about 50 $\mu$m below the surface of the metallic product to be treated.

10. The method of any one of claims 7, 8 or 9 wherein surfaces of the shots are further work-hardened and surface quality of the shots is enhanced by striking the different diameter shots against one another.

* * * * *